US007791580B2

(12) United States Patent
Chung

(10) Patent No.: US 7,791,580 B2
(45) Date of Patent: Sep. 7, 2010

(54) CIRCUITS AND METHODS FOR GENERATING A COMMON VOLTAGE

(75) Inventor: Kyu-Young Chung, Seoul (KR)

(73) Assignee: Samsung Electronics Co., Ltd., Suwon-Si, Gyeonggi-Do (KR)

( * ) Notice: Subject to any disclaimer, the term of this patent is extended or adjusted under 35 U.S.C. 154(b) by 713 days.

(21) Appl. No.: 11/745,153

(22) Filed: May 7, 2007

(65) Prior Publication Data

US 2008/0042958 A1 Feb. 21, 2008

(30) Foreign Application Priority Data

May 12, 2006 (KR) ..... 10-2006-0042730

(51) Int. Cl.
*G09G 3/36* (2006.01)

(52) U.S. Cl. ..... 345/98

(58) Field of Classification Search ..... 345/84, 345/87–111, 211–215
See application file for complete search history.

(56) References Cited

U.S. PATENT DOCUMENTS 5,798,741 A * 8/1998 Kajihara ..... 345/94
7,209,102 B2 * 4/2007 Moon ..... 345/87
7,342,562 B2 * 3/2008 Kawase et al. ..... 345/87
2005/0088395 A1 * 4/2005 Chung ..... 345/98
2005/0219185 A1 * 10/2005 Hung et al. ..... 345/90
2006/0007095 A1 * 1/2006 Kudo et al. ..... 345/98
2006/0158412 A1 * 7/2006 Morita ..... 345/94

FOREIGN PATENT DOCUMENTS

JP 2000-267616 9/2000
JP 2002-366114 12/2002
JP 2003-216256 7/2003
KR 1020040047689 6/2004

OTHER PUBLICATIONS

English Abstract for Publication No. 2000-267618.
English Abstract for Publication No. 2002-366114.
English Abstract for Publication No. 2003-216256.
English Abstract for Publication No. 1020040047669.

* cited by examiner

*Primary Examiner*—Chanh Nguyen
*Assistant Examiner*—Pegeman Karimi
(74) *Attorney, Agent, or Firm*—F. Chau & Associates, LLC

(57) ABSTRACT

A circuit and a method for generating a common voltage, and a liquid crystal display (LCD) device including the circuit for generating a common voltage. Chip size and accumulated offset voltage of a liquid crystal display (LCD) may be reduced. The circuit for generating a common voltage includes a digital logic calculator, an input reference voltage generator, and a buffer unit. Prior to the generation of the common voltage, the digital logic calculator sets an input reference voltage corresponding to a target voltage.

24 Claims, 5 Drawing Sheets

FIG. 4

| VCOMH[n:1] | VCOMH TARGET VOLTAGE |
|---|---|
| 0 | Va |
| 1 | Va+Vs |
| 2 | Va+2Vs |
| ... | ... |
| $2^n-1$ | $Va+(2^n-1)Vs$ |

FIG. 5

| VCOMA[m:1] | VCOMA TARGET VOLTAGE |
|---|---|
| 0 | Vb |
| 1 | Vb+Vs |
| 2 | Vb+2Vs |
| ... | ... |
| $2^m-1$ | $Vb+(2^m-1)Vs$ |

FIG. 6

| VCOML[l:1] | VCOML TARGET VOLTAGE |
|---|---|
| 0 | $Va+(2^n-1)Vs-Vb$ |
| 1 | $Va+(2^n-2)Vs-Vb$ |
| 2 | $Va+(2^n-3)Vs-Vb$ |
| ... | ... |
| $2^l-1$ | $Va-(2^n-1)Vs-Vb$ |

CIRCUITS AND METHODS FOR GENERATING A COMMON VOLTAGE

CROSS-REFERENCE TO RELATED APPLICATIONS

This application claims priority under 35 USC §119 to Korean Patent Application No. 10-2006-0042730, filed on May 12, 2006 in the Korean Intellectual Property Office (KIPO), the disclosure of which is hereby incorporated by reference herein in its entirety.

BACKGROUND OF THE INVENTION

1. Technical Field

Exemplary embodiments of the present invention relate to circuits, and more particularly, to circuits and methods for generating a common voltage.

2. Discussion of the Related Art

Various types of flat panel displays, such as a liquid crystal display (LCD), a plasma display panel (PDP), an electroluminescence display panel, etc., have been developed to replace conventional cathode ray tube (CRT) displays. Such flat panel displays are suitable for devices and applications requiring small size, light weight and low power consumption. For example, the LCD can be driven by large scale integration (LSI) drivers since the LCD can be operated at a low-power supply voltage and thus has low power consumption. Therefore, the LCD has been widely implemented for laptop computers, cellular phones, pocket computers, automobiles, color televisions, etc. Such characteristics of LCDs as the small size, light weight and low power consumption render LCDs suitable for use with portable devices.

FIG. 1 is a diagram illustrating a conventional display system.

Referring to FIG. 1, a display system 100 includes a display panel 110 (e.g., an LCD) and a plurality of components for driving and controlling the display panel 110. The plurality of components include a source driving integrated circuit (IC) 120, a gate driving IC 130, a controller 140 having graphic random access memory (GRAM), and a power generator 150. The controller 140 generates control signals to control the power generator 150, the source driving IC 120, and the gate driving IC 130.

The display panel 110 is coupled to the source driving IC 120 through a plurality of data lines D1 through Dm and coupled to the gate driving IC 130 through a plurality of gate lines G1 through Gn. The display panel 110 includes a plurality of pixels/subpixels that are arranged in a matrix of rows and columns. The pixels/subpixels in a given row are commonly coupled to a gate line and the pixels/subpixels in a given column are commonly coupled to a data line. Depending on the design of the display panel 110, one pixel/subpixel may be formed at each intersection of a gate line and a data line.

If the display panel 110 is a thin-film transistor (TFT) LCD, the display panel 110 includes a TFT board comprising a plurality of pixels/subpixels arranged in matrix form. As shown in FIG. 1, each pixel/subpixel unit includes a TFT, a liquid crystal capacitor CL, which is connected between a drain electrode of the TFT and a common electrode VCOM, and a storage capacitor Cst, which is connected in parallel with the liquid crystal capacitor CL. The storage capacitor Cst stores an electric charge and an image on the display is maintained during a non-selected period. The liquid crystal capacitor CL is formed by a common electrode VCOM of a plate, a pixel electrode of the TFT and liquid crystal material therebetween. A source electrode of the TFT is coupled to a data line, and a gate electrode of the TFT is coupled to a gate line. The TFT acts as a switch that applies a source voltage on the data line to the pixel electrode when a gate driver signal VGH on the gate line is applied to the gate of the TFT.

The power generator 150 generates a plurality of reference voltages, including a source driver power supply AVDD and a gamma reference voltage GVDD that are applied to the source driving IC 120. A high common electrode voltage VCOMH and a low common electrode voltage VCOML are applied to the common electrode VCOM of the display panel 110. A gate driver turn-on voltage VGON and a gate driver turn-off voltage VGOFF are applied to the gate driving IC 130 and selected gate lines are driven.

The controller 140 receives as input a plurality of driving data signals and driving control signals that are output from an image supply source (e.g., a main board of a computer). The driving data signals include red-green-blue (RGB) data for forming an image on the display panel 110. The driving control signals include vertical synchronous signals (Vsync), horizontal synchronous signals (Hsync), a data enable signal (DE) and a clock signal (CK). The controller 140 outputs to the source driving IC 120 a plurality of display data signals DDATA which correspond to RGB data and source control signals. The controller 140 outputs gate control signals to control the gate driving IC 130. The controller 140 controls the timing at which data and control signals are output from the source driving IC 120 and the gate driving IC 130. For example, in one mode of operation, the controller 140 generates the source and gate control signals such that the gate driving IC 130 transmits a gate driver output signal VGON to each of the gate lines G1 through Gn in a consecutive manner, and a data voltage is selectively applied one-by-one to each pixel/subpixel in an activated row, in order. In another mode of operation, the pixels/subpixels can be charged by sequentially scanning pixels/subpixels in a first column and thereafter scanning pixels/subpixels in a next column.

The gate driving IC 130 includes a plurality of gate drivers that respectively drive the corresponding gate lines G1 through Gn. The source driving IC 120 includes a plurality of source driver circuits 120-1 through **120-*m* which respectively drive the corresponding data lines D1** through Dm.

FIG. 2 is a diagram illustrating a conventional common voltage generating circuit that is included in the power generator in FIG. 1.

Referring to FIG. 2, a conventional common voltage generating circuit 200 includes an input reference voltage generator 210, a first operational amplifier (op-amp) 222, a second op-amp 224, a third op-amp 226, and a fourth op-amp 228.

The input reference voltage generator 210 receives a value of a first register VCMH[n:1] that is set to a target value of a maximum voltage of a common voltage, and a value of a second register VCMA[m:1] that is set to a target value of an amplitude of the common voltage. Thus, the input reference voltage generator 210 outputs a maximum input reference voltage VCMH_R and an amplitude input reference voltage VCMA_R.

When an input offset voltage of the op-amps 222, 224, 226, and 228 is "0," a voltage at a node N1 is (a+1)VCMH_R. When a gain of the second op-amp 224 is "1," a voltage at a node N2 is (a+1)VCMH_R. When the gain of the third op-amp 226 is "1," a voltage at a node N4 is VCMA_R. A voltage at a node N3 is (a+1)/(b+1)×VCMH_R and a voltage at a node N5 is (a+1)/(b+1)×VCMH_R. Therefore, a voltage at a node N6 is (a+1)VCMH_R−b×VCMA_R. Namely, VCOMH, the voltage of the node N2, is (a+1)VCMH_R, and VCOML, the voltage of the node N6, is (a+1)VCMH_R−b×VCMA_R. Accordingly, VCOML is VCOMH−b×VCMA_R.

However, a practical op-amp has an input offset voltage due to mismatches, etc. When the input offset voltage of each of the op-amps 222, 224, 226, and 228 is Voff1, Voff2, Voff3, and Voff4, respectively, VCOMH and VCOML are determined by Equation 1 and Equation 2:

$$VCOMH=(a+1)VCMH_R-((a+1)V\text{off}1+V\text{off}2) \quad \text{Equation 1}$$

$$VCOML=VCOMH-b(VCMA_R)-((a+1)V\text{off}1+V\text{off}2+bV\text{off}3+(b+1)V\text{off}4) \quad \text{Equation 2}$$

(a+1)Voff1+Voff2, the offset voltage generated at the output of VCOMH, is cumulatively represented at the output of VCOML. Resistances bR2 and R2 dividing VCOMH are used for calculating VCOML. The resistances bR2 and R2 have high values and the generating current is decreased. Because sizes of the resistances bR2 and R2 increase, when considering a whole chip, a problem of block size appears. In addition, when VCOMH is applied to the op-amp 228 calculating VCOML, noise and overcurrent may be generated by peak noise that is generated when driving VCOM. Thus, a problem of requiring an output terminal buffer 224 appears. Because VCOML is calculated from VCOMH, the conventional common voltage generating circuit may have problems of size and accumulation at VCOML of an offset voltage that is generated at VCOMH.

SUMMARY OF THE INVENTION

Some exemplary embodiments of the present invention provide a circuit for generating a common voltage capable of decreasing size and offset voltage.

Some exemplary embodiments of the present invention provide a method of generating a common voltage capable of decreasing size and offset voltage.

Some exemplary embodiments of the present invention provide a liquid crystal display (LCD) device including the circuit for generating a common voltage capable of decreasing size and offset voltage.

In some exemplary embodiments of the present invention, a method of generating a common voltage comprises setting a first control register and an amplitude control register to a first target voltage of a common voltage and a target amplitude of the common voltage, respectively. A second control register is set to a second target voltage of the common voltage based on the first target voltage and the target amplitude. A first input reference voltage and a second input reference voltage corresponding to the setting values of the first and second control registers, respectively, are generated. A first common voltage and a second common voltage are output by receiving the first and second input reference voltages, respectively.

Calculation of the setting value of the second control register may be performed by a digital logic calculator.

The first control register may be an n-bit register, where n is a positive integer. The second control register may be an L-bit register, where "L" is a positive integer. The amplitude control register may be an m-bit register, where m is a positive integer.

The first target voltage may correspond to one of Va, Va+Vs, Va+2Vs, . . . , and Va+$(2^n-1)$Vs according to a bit value of the first control, register.

The target amplitude may correspond to one of Vb, Vb+Vs, Vb+2Vs, . . . , and Vb+$(2^m-1)$Vs according to a bit value of the amplitude control register.

The second target voltage may correspond to one of Va+$(2^n-1)$Vs−Vb, Va+$(2^n-2)$Vs−Vb, . . . , and Va+$(2^m-1)$Vs−Vb according to a bit value of the second control register.

The first common voltage may be outputted by an operational amplifier (op-amp) having a gain of a+1, where "a" is a positive integer.

The second common voltage may be outputted by an op-amp having a gain of 1 and an op-amp having a gain of −b, where "b" is a positive integer, cascade-coupled with each other.

The first common voltage may be outputted as a high common voltage.

The second common voltage may be outputted as a low common voltage.

In some exemplary embodiments of the present invention, a circuit for generating a common voltage comprises a digital logic calculator, an input reference voltage generator, and a buffer unit. The digital logic calculator outputs a value of a second control register that, is set to a second target voltage of a common voltage by receiving a value of an amplitude control register that is set to a target amplitude of the common voltage. The input reference voltage generator generates a first input reference voltage and a second input reference voltage by receiving a value of a first control register that is set to a first target voltage of the common voltage and the value of the second control register. The buffer unit outputs a first common voltage and a second common voltage by receiving the first input reference voltage and the second input reference voltage.

The common voltage driver may receive the first common voltage and the second common voltage and provide the first common voltage and the second common voltage to a common electrode.

The digital logic calculator may output by calculating the value of the amplitude control register and the value of the first control register.

The first control register may be an n-bit register, where "n" is a positive integer, the second control register may be an L-bit register, where "L" is a positive number, and the amplitude control register may be an m-bit register, where m is a positive integer.

The first target voltage may correspond to one of Va, Va+Vs, Va+2Vs, . . . , and Va+$(2^n-1)$Vs according to a bit value of the first control register.

The target amplitude may correspond to one of Vb, Vb+Vs, Vb+2Vs, . . . , and Vb+$(2^m-1)$Vs according to a bit value of the amplitude control register.

The second target voltage may correspond to one of Va+$(2^n-1)$Vs−Vb, Va+$(2^n-2)$Vs−Vb, . . . , and Va+$(2^m-1)$Vs−Vb according to a bit value of the second control register.

The buffer unit may comprise a high buffer and a low buffer. The high buffer may output the first common voltage by receiving the first input reference voltage. The low buffer may output the second common voltage by receiving the second input reference voltage.

The high buffer may include an op-amp having a gain of a+1, where "a" is a positive integer.

The low buffer may include an op-amp having a gain of 1 and an op-amp having a gain of −b, where "b" is a positive integer.

The op-amps of the low buffer may be cascade-coupled with each other.

The first common voltage may be outputted as a high common voltage and the second common voltage may be outputted as a low common voltage.

An LCD comprises a liquid crystal display panel, a gate driver, a source driver, and a common voltage driver circuit.

The liquid crystal display panel couples to a plurality of gate lines and data lines. The gate driver drives the gate lines of the liquid crystal display panel. The source driver drives the data lines of the liquid crystal display panel. The common voltage driver circuit drives a common voltage that is applied to common electrode of the liquid crystal display panel.

The common voltage driver circuit includes a common voltage generator and a common voltage driver. The common voltage generator comprises a digital logic calculator, an input reference voltage generator, and a buffer unit. The digital logic calculator outputs a value of a second control register that is set to a second target voltage of a common voltage by receiving a value of an amplitude control register that is set to a target amplitude of the common voltage. The input reference voltage generator generates a first input reference voltage and a second input reference voltage by receiving a value of a first control register that is set to a first target voltage of the common voltage and the value of the second control register. The buffer unit outputs a first common voltage and a second common voltage by receiving the first input reference voltage and the second input reference voltage. The common voltage driver receives and provides the first common voltage and the second common voltage to the common electrode.

The common voltage generating circuit and method according to exemplary embodiments of the present invention may decrease the size of a chip and the offset voltage.

BRIEF DESCRIPTION OF THE DRAWINGS

These and/or other aspects and features of exemplary embodiments of the present general inventive concept will become apparent and more readily appreciated from the following description of the exemplary embodiments, taken in conjunction with the accompanying drawings of which:

FIG. 4 is a table showing examples of a first target voltage according to a bit value of a first control register;

FIG. 5 is a table showing examples of a target amplitude according to a bit value of an amplitude control register; and FIG. 6 is a table showing examples of a second target voltage according to a bit value of a second control register.

DETAILED DESCRIPTION OF THE EXEMPLARY EMBODIMENTS

Exemplary embodiments of the present invention will now be described more fully with reference to the accompanying drawings, in which exemplary embodiments of the invention are shown. This invention may, however, be embodied in many different forms and should not be construed as limited to the exemplary embodiments set forth herein.

It will be understood that when an element is referred to as being "connected" or "coupled" to another element, it can be directly connected or coupled to the other element or intervening elements may be present.

Figure 3:
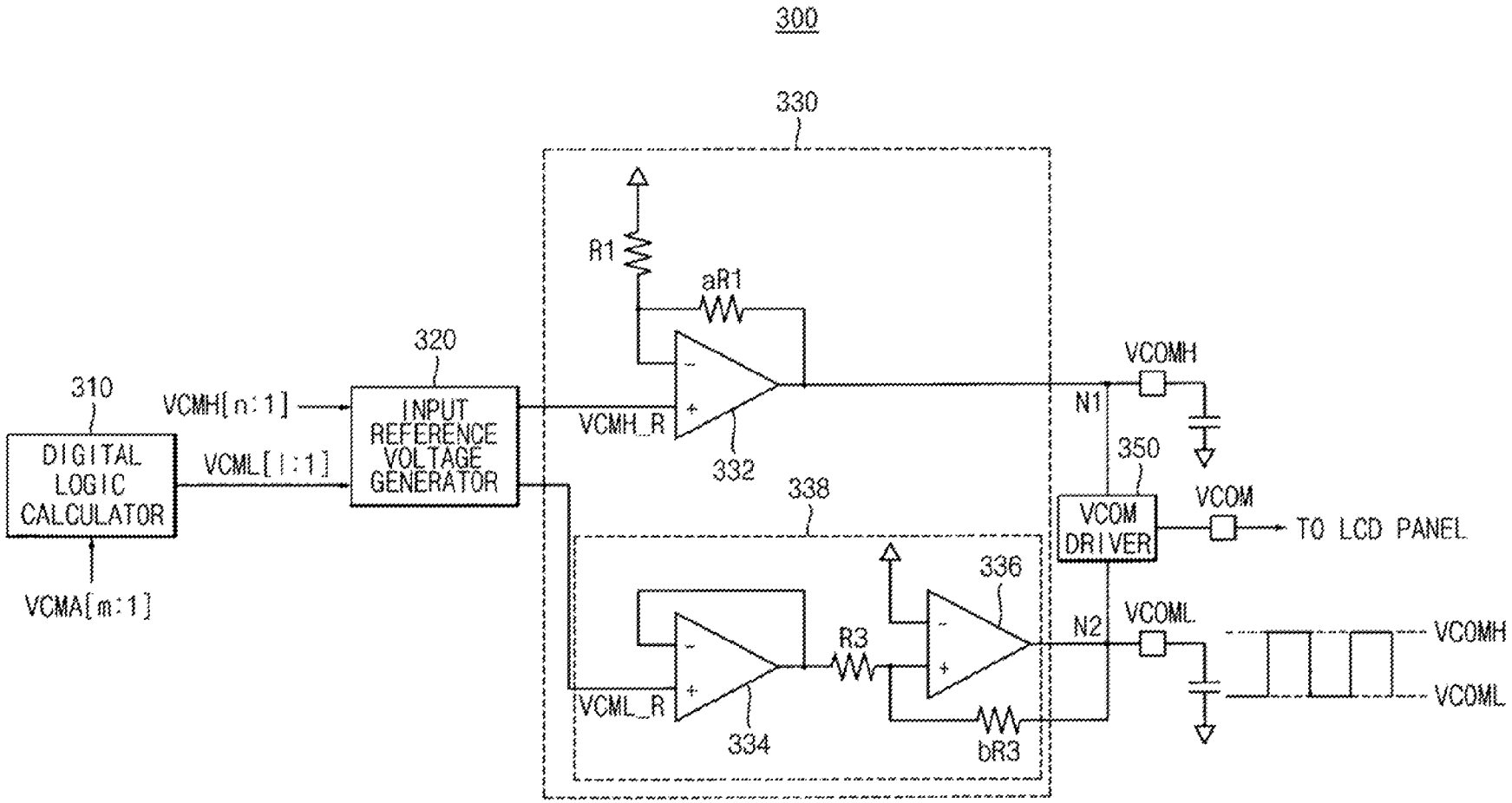
FIG. 3 is a diagram illustrating a common voltage generating circuit according to an exemplary embodiment of the present invention.

FIG. 3 is a diagram illustrating a common voltage generating circuit according to an exemplary embodiment of the present invention. The common voltage generating circuit in FIG. 3 may be applied to the system in FIG. 1.

FIG. 4 is a table showing examples of a first target voltage according to a bit value of a first control register.

FIG. 5 is a table showing examples of a target amplitude according to a bit value of an amplitude control register.

FIG. 6 is a table showing examples of a second target voltage according to a bit value of a second control register.

Referring to FIG. 3, a common voltage generating circuit 300 includes a digital logic calculator 310, an input reference voltage generator 320, and a buffer unit 330.

The digital logic calculator 310 outputs a value VCML[L:1] of a second control register that is set to a second target voltage of a common electrode voltage VCOM by receiving a value VCMA[m:1] of an amplitude control register that is set to a target amplitude of the common voltage. The digital logic calculator 310 calculates a value VCMA[m:1] of the amplitude control register and a value VCMH[n:1] of the first control register. As shown in FIG. 4 through FIG. 6, for example, when the first target voltage is Va, Va+Vs, Va+2Vs, . . . , Va+$(2^n-1)$Vs according to a bit value of the first control register, and the target amplitude is Vb, Vb+Vs, Vb+2Vs, . . . , Vb+$(2^m-1)$Vs according to a bit value of the amplitude control register, the second target voltage is Va+$(2^n-1)$Vs−Vb, Va+$(2^n-2)$Vs−Vb, . . . , Va+$(2^m-1)$Vs−Vb according to a bit value of the second control register. When the value VCMA[m:1] of the amplitude control register is inputted, the digital logic calculator 310 stores the value. Then, the digital logic calculator 310 outputs a value VCML[L:1]. The value VCML[L:1] of a second control register is calculated according to the value VCMA[m:1] of the amplitude control register and the value VCMH[n:1] of the first control register.

The input reference voltage generator 320 generates a first input reference voltage VCMH_R and a second input reference voltage VCML_R by receiving the value VCMH[n:1] of the first control register that is set to the first target voltage of the common voltage, and the value VCML[L:1] of the second control register.

The buffer unit 330 outputs a high common electrode voltage VCOMH and a low common electrode voltage VCOML by receiving the first input reference voltage VCMH_R and the second input reference voltage VCML_R. The high common electrode voltage VCOMH and the low common electrode voltage VCOML are applied to a liquid crystal display panel by a common voltage driver 350.

The buffer unit 330 includes a first operational amplifier (op-amp) 332, a third op-amp 334, and a fourth op-amp 336. The first op-amp 332 outputs the high common electrode voltage VCOMH by receiving the first input reference voltage VCMH_R. The third op-amp 334 outputs the second input reference voltage VCML_R by receiving the second input reference voltage VCML_R. The third op-amp 334 and the fourth op-amp 336 are cascade-coupled with each other. A high buffer includes the first op-amp 332, and a lower buffer 338 includes the third op-amp 334 and the fourth op-amp 336. When an input offset voltage of the first op-amp 332 is Voff1, an input offset voltage of the third op-amp 334 is Voff3, and an input offset voltage of the fourth op-amp 336 is Voff4, the high common electrode voltage VCOMH at the node N1 may be determined by Equation 3:

$$VCOMH=(a+1)VCMH_R-(a+1)V\text{off1} \qquad \text{Equation 3}$$

Comparing Equation 3 with Equation 1, because Voff2 does not appear in Equation 3, an output offset voltage may be improved by an amount of Voff2.

The low common electrode voltage VCOML at the node N2 may be determined by Equation 4:

$$VCOML=-b(VCML_R)-(bV\text{off3}+(b+1)V\text{off4}) \qquad \text{Equation 4}$$

Figure 2:
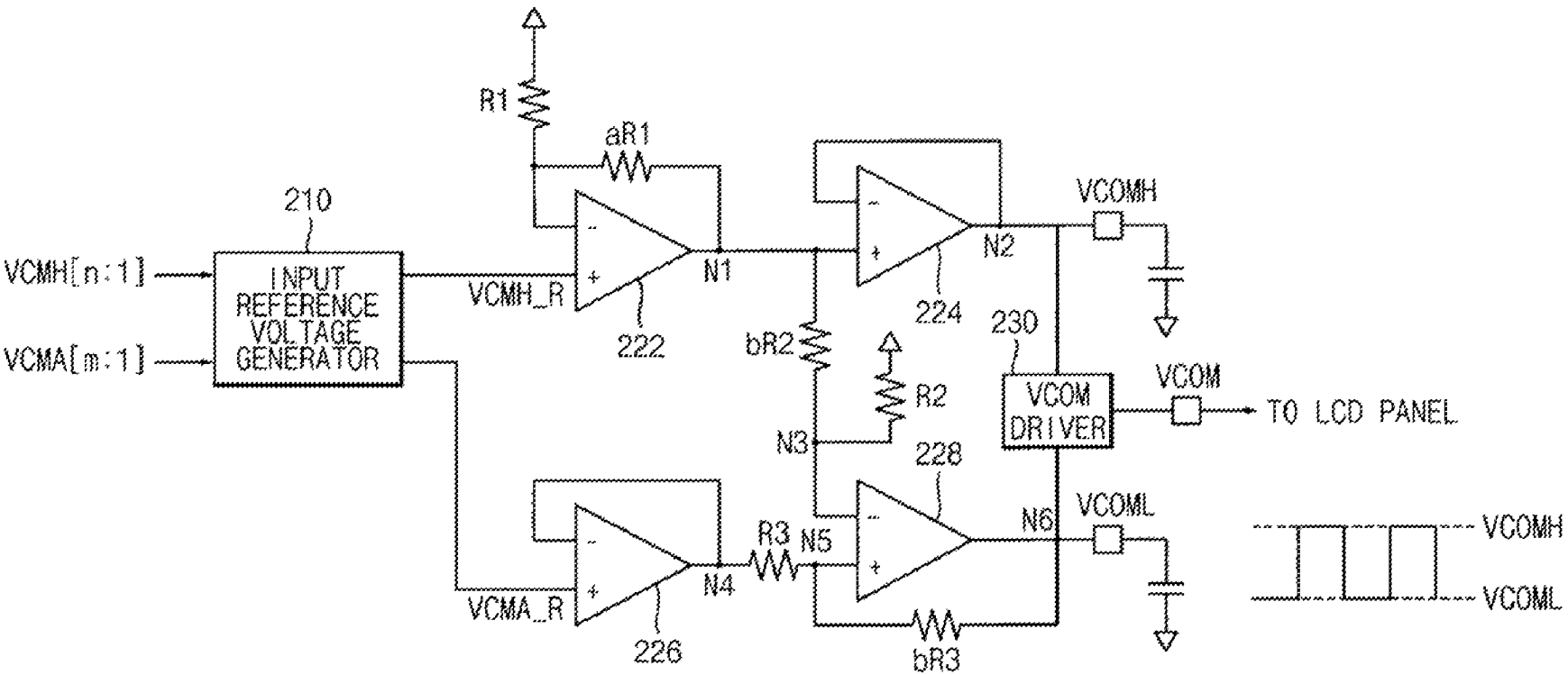
FIG. 2 (CONVENTIONAL ART)
FIG. 2 is a diagram illustrating a conventional common voltage generating circuit that is included in the power generator in FIG. 1.

Comparing Equation 4 with Equation 2, an output offset voltage may be improved by an amount of (a+1)Voff1+Voff2. The offset voltage of VCOMH is not accumulated. In addition, comparing the circuits in FIG. 2 and FIG. 3, the circuit in FIG. 3 does not require the buffer 224 for eliminating noise and the resistances bR2 and R2 for decreasing the current in FIG. 2. Thus, the size of the chip may be reduced.

In the conventional common voltage generating circuit, because the low common electrode voltage VCOML is outputted through an analog calculator as in the op-amp 228, the problems of an increased chip size and accumulated offset voltage may be caused. However, in exemplary embodiments the present invention, an input reference voltage corresponding to the low common electrode voltage VCOML is previously set by the digital logic calculator 310 the number of op-amps and the number of the resistors may be reduced, and the offset voltage need not be accumulated.

Hereinafter, with reference to FIGS. 3, 4, 5 and 6, a method of generating a common voltage according to an exemplary embodiment of the present invention is described.

According to the method for generating a common voltage, a first target voltage of a common voltage and a target amplitude of the common voltage are set at a first control register VCMH[n:1] and an amplitude control register VCMA[m:1], respectively. A second target voltage of the common voltage is set at a second control register VCML[L:1] by using the digital logic calculator 310.

As shown in FIG. 4 through FIG. 6, for example, the first target voltage is Va, Va+Vs, Va+2Vs, . . . , Va+$(2^n-1)$Vs according to a bit value of the first, control register. The target amplitude is Vb, Vb+Vs, . . . , Vb+2Vs, . . . , Vb+$(2^m-1)$Vs according to a bit value of the amplitude control register. The second target voltage that is outputted from the digital logic calculator 310 is Va+$(2^n-1)$Vs−Vb, Va+$(2^n-2)$Vs−Vb, . . . , Va+$(2^m-1)$Vs−Vb according to a bit value of the second control register.

A first input reference voltage VCMH_R and a second input reference voltage VCML_R are generated by a first control register VCMH[n:1] and a second control register VCML[L:1], respectively.

A first common voltage VCOMH and a second common voltage VCOML are outputted by receiving the first input reference voltage VCMH_R and the second input reference voltage VCML_R, respectively.

Figure 1:
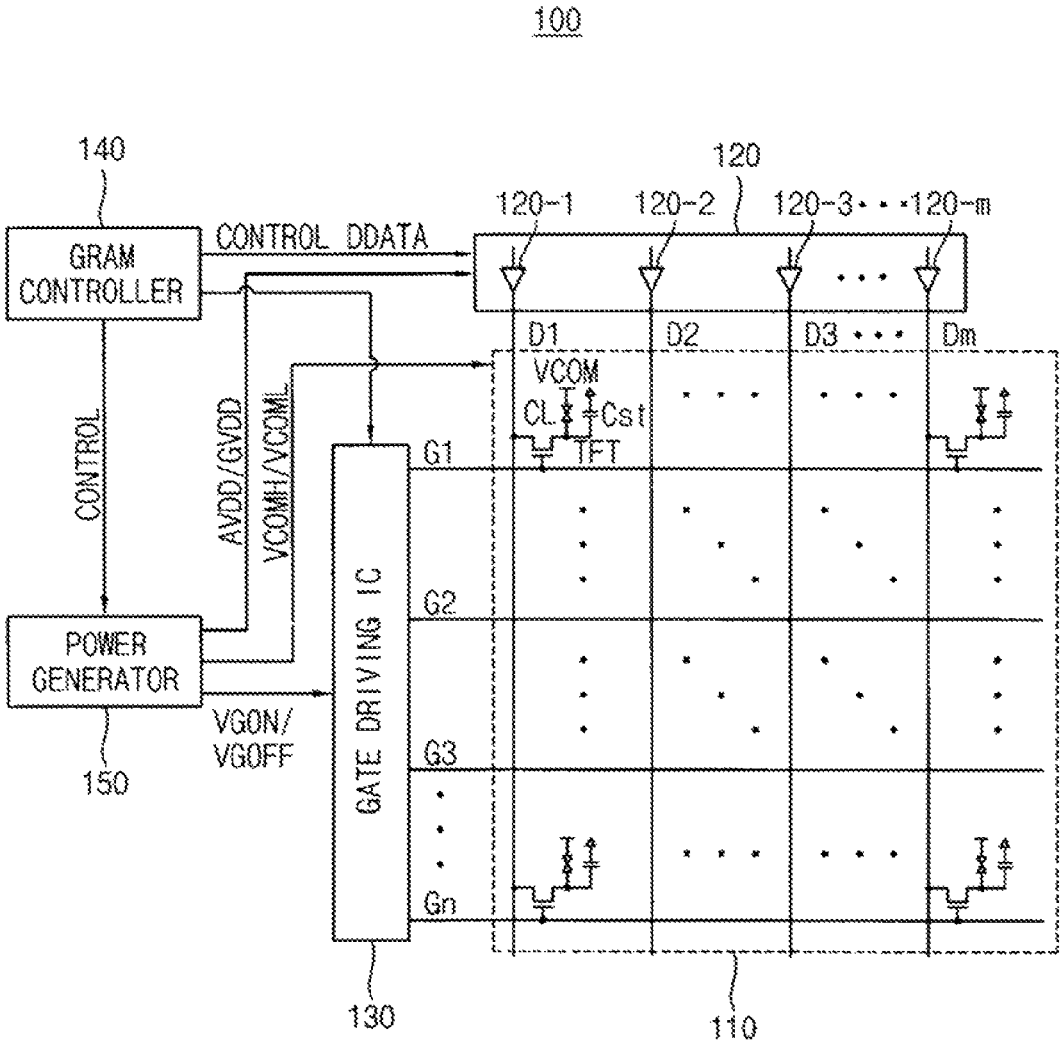
FIG. 1 (CONVENTIONAL ART)
FIG. 1 is a diagram illustrating a conventional display system.

The common voltage generating circuit in FIG. 3 may be applied to a display system as illustrated in FIG. 1.

If the common voltage generating circuit in FIG. 3 is applied to the system in FIG. 1, a chip size and accumulated offset voltage of a liquid crystal display (LCD) may be reduced.

As mentioned above, the common voltage generating circuit and method, and the LCD device including the common voltage generating circuit according to exemplary embodiments of the present invention may decrease the size of a chip by reducing the number of op-amps and the number of resistors. Problems of accumulated offset voltage may be reduced or eliminated. An input reference voltage corresponding to a target voltage of VCOML may be previously set by a digital logic calculator.

While the exemplary embodiments of the present invention have been described in detail, it should be understood that various changes, substitutions and alterations may be made herein without departing from the scope of the invention.

What is claimed is:

1. A method of generating a common voltage comprising:

setting a first control register and an amplitude control register to a value of a first target voltage of a common voltage and a value of a target amplitude of the common voltage, respectively;

setting a second control register to a value of a second target voltage of the common voltage based on the first target voltage of the common voltage and the target amplitude of the common voltage;

generating a first input reference voltage and a second input reference voltage corresponding to the values of the first and second control registers, respectively; and outputting a first common voltage and a second common voltage by receiving the first and second input reference voltages, respectively.

2. The method of claim 1, wherein calculating the value the second control register is set to is performed by a digital logic calculator.

3. The method of claim 2, wherein the first control register is an n-bit register, the second control register is an L-bit register, and the amplitude control register is an m-bit register, wherein n, L, m are positive integers.

4. The method of claim 3, wherein the first target voltage corresponds to one of Va, Va+Vs, Va+2Vs, . . . , or Va+$(2^n-1)$Vs according to a bit value of the first control register.

5. The method of claim 3, wherein the target amplitude corresponds to one of Vb, Vb+Vs, Vb+2Vs, . . . , or Vb+$(2^m-1)$Vs according to a bit value of the amplitude control register.

6. The method of claim 3, wherein the second target voltage corresponds to one of Va+$(2^n-1)$Vs−Vb, Va+$(2^n-2)$Vs−Vb, . . . , or Va+$(2^m-1)$Vs−Vb according to a bit value of the second control register.

7. The method of claim 1, wherein the first common voltage is outputted by an operational amplifier (op-amp) having a gain of a+1, wherein a is a positive integer.

8. The method of claim 7, wherein the first common voltage is outputted as a high common voltage.

9. The method of claim 1, wherein the second common voltage is outputted by an op-amp having a gain of 1 and an op-amp having a gain of −b that are cascade-coupled with each other, wherein b is a positive integer.

10. The method of claim 9, wherein the second common voltage is outputted as a low common voltage.

11. A circuit for generating a common voltage comprising:

a digital logic calculator configured to output a value of a second control register that is set to a second target voltage of a common voltage by receiving a value of an amplitude control register that is set to a target amplitude of the common voltage;

an input reference voltage generator configured to generate a first input reference voltage and a second input reference voltage by receiving a value of a first control register that is set to a first target voltage of the common voltage and the value of the second control register, respectively; and a buffer unit configured to output a first common voltage and a second common voltage by receiving the first input reference voltage and the second input reference voltage, respectively.

12. The circuit of claim 11, further comprising:

a common voltage driver configured to receive the first common voltage and the second common voltage and provide the first common voltage and the second common voltage to a common electrode.

13. The circuit of claim 12, wherein the buffer unit comprises:

a high buffer configured to output the first common voltage by receiving the first input reference voltage; and a low buffer configured to output the second common voltage by receiving the second input reference voltage.

14. The circuit of claim 13, wherein the high buffer includes an op-amp having a gain of a+1, wherein a is a positive integer.

15. The circuit of claim 13, wherein the low buffer includes an op-amp having a gain of 1 and an op-amp having a gain of −b, wherein b is a positive integer.

16. The circuit of claim 15, wherein the op-amp of the low buffer having a gain of 1 and the op-amp of the low buffer having a gain of −b are cascade-coupled with each other.

17. The circuit of claim 13, wherein the first common voltage is outputted as a high common voltage and the second common voltage is outputted as a low common voltage.

18. The circuit of claim 11, wherein the digital logic calculator calculates the value of the amplitude control register and the value of the first control register.

19. The circuit of claim 18, wherein the first control register is an n-bit register, the second control register is an L-bit register, and the amplitude control register is an m-bit register, wherein n, L, m are positive integers.

20. The circuit of claim 19, wherein the first target voltage corresponds to one of Va, Va+Vs, Va+2Vs, . . . , or $Va+(2^n-1)Vs$ according to a bit value of the first control register.

21. The circuit of claim 19, wherein the target amplitude corresponds to one of Vb, Vb+Vs, Vb+2Vs, . . . , or $Vb+(2^m-1)Vs$ according to a bit value of the amplitude control register.

22. The circuit of claim 19, wherein the second target voltage corresponds to one of $Va+(2^n-1)Vs-Vb$, $Va+(2^n-2)Vs-Vb$, . . . , or $Va+(2^m-1)Vs-Vb$ according to a bit value of the second control register.

23. A liquid crystal display, LCD comprising:

a liquid crystal display panel coupled to a plurality of gate lines and data lines;

a gate driver configured to drive the gate lines of the liquid crystal display panel;

a source driver configured to drive the data lines of the liquid crystal display panel; and a common voltage driver circuit configured to drive a common voltage that is applied to a common electrode of the liquid crystal display panel, the common voltage driver circuit comprising a common voltage generator and a common voltage driver receiving and providing the first common voltage and the second common voltage to the common electrode, the common voltage generator comprising:

a digital logic calculator outputting a value of a second control register that is set to a second target voltage of a common voltage by receiving a value of an amplitude control register that is set to a target amplitude of the common voltage;

an input reference voltage generator generating a first input reference voltage and a second input reference voltage by receiving a value of a first control register that is set to a first target voltage of the common voltage and the value of the second control register, respectively; and a buffer unit outputting a first common voltage and a second common voltage by receiving the first input reference voltage and the second input reference voltage, respectively.

24. The LCD of claim 23, wherein the digital logic calculator calculates the value of the amplitude control register and the value of the first control register.

* * * * *